US006102526A

United States Patent [19]

Tunius

[11] Patent Number: 6,102,526

[45] Date of Patent: Aug. 15, 2000

[54] IMAGE FORMING METHOD AND DEVICE UTILIZING CHEMICALLY PRODUCED TONER PARTICLES

[75] Inventor: Mats Tunius, Yokohama, Japan

[73] Assignee: Array Printers AB, Vastra Frolunda, Sweden

[21] Appl. No.: 09/055,192

[22] Filed: Apr. 3, 1998

Related U.S. Application Data

[63] Continuation-in-part of application No. 08/989,554, Dec. 12, 1997.

[51] Int. Cl.[7] ..... B41J 2/06

[52] U.S. Cl. ..... 347/55

[58] Field of Search ..... 347/55, 95, 103, 347/43, 154, 123, 111, 159, 127, 128, 17, 141, 120, 151; 399/271, 290, 292, 293, 294, 295

[56] References Cited

U.S. PATENT DOCUMENTS

| | | | |
|---|---|---|---|
| 3,566,786 | 3/1971 | Kaufer et al. . | |
| 3,689,935 | 9/1972 | Pressman et al. . | |
| 3,779,166 | 12/1973 | Pressman et al. . | |
| 3,815,145 | 6/1974 | Tisch et al. . | |
| 4,263,601 | 4/1981 | Nishimura et al. . | |
| 4,274,100 | 6/1981 | Pond . | |
| 4,307,169 | 12/1981 | Matkan | 430/111 |
| 4,353,080 | 10/1982 | Cross . | |
| 4,382,263 | 5/1983 | Fischbeck et al. . | |
| 4,384,296 | 5/1983 | Torpey . | |
| 4,386,358 | 5/1983 | Fischbeck . | |
| 4,470,056 | 9/1984 | Galetto et al. . | |
| 4,478,510 | 10/1984 | Fujii et al. . | |
| 4,491,855 | 1/1985 | Fujii et al. . | |
| 4,498,090 | 2/1985 | Honda et al. . | |
| 4,511,907 | 4/1985 | Fukuchi . | |
| 4,525,727 | 6/1985 | Kohashi et al. . | |
| 4,571,601 | 2/1986 | Teshima . | |
| 4,675,703 | 6/1987 | Fotland . | |
| 4,717,926 | 1/1988 | Hotomi . | |

(List continued on next page.)

FOREIGN PATENT DOCUMENTS

| | | | |
|---|---|---|---|
| 0345 024 A2 | 6/1989 | European Pat. Off. . | |
| 0352 997 A2 | 1/1990 | European Pat. Off. . | |
| 0377 208 A2 | 7/1990 | European Pat. Off. . | |
| 0660 201 A2 | 6/1995 | European Pat. Off. . | |
| 0 715 218 A1 | 6/1996 | European Pat. Off. | G03G 9/08 |
| 072 072 A2 | 7/1996 | European Pat. Off. . | |
| 0 743 572 A1 | 11/1996 | European Pat. Off. . | |
| 0752 317 A1 | 1/1997 | European Pat. Off. . | |
| 0764 540 A2 | 3/1997 | European Pat. Off. . | |
| 12 70 856 | 6/1968 | Germany . | |

(List continued on next page.)

OTHER PUBLICATIONS

"The Best of Both Worlds," Brochure of Toner Jet by Array Printers, The Best of Both Worlds, 1990.

International Congress on Advances in Non–Impact Printing Technologies, 1994, pp. 311–313.

E. Bassous, et al., "The Fabrication of High Precision Nozzles by the Anisotropic Etching of (100) Silicon", J. Electrochem. Soc.: Solid–State Science and Technology, vol. 125, No. 8, Aug. 1978, pp. 1321–1327.

*Primary Examiner*—John Barlow
*Assistant Examiner*—Charles W. Stewart, Jr.
*Attorney, Agent, or Firm*—Knobbe, Martens, Olson & Bear, LLP

[57] ABSTRACT

In an image recording method, the toner particles are preferably obtained by microencapsulation techniques. The techniques form a dispersion of a core material in a medium containing the shell material. The shell material is deposited upon the surface of the core material to form the capsules. The capsules are hardened to prevent their agglomeration. The capsules are then recovered. Preferably, the continuous phase is normally a solution of the shell material. The core structure advantageously comprises a colorant and at least one additive, such as, for example, a resin binder.

12 Claims, 2 Drawing Sheets

U.S. PATENT DOCUMENTS

| | | | |
|---|---|---|---|
| 4,743,926 | 5/1988 | Schmidlin et al. . | |
| 4,748,453 | 5/1988 | Lin et al. . | |
| 4,814,796 | 3/1989 | Schmidlin . | |
| 4,831,394 | 5/1989 | Ochiai et al. . | |
| 4,860,036 | 8/1989 | Schmidlin . | |
| 4,903,050 | 2/1990 | Schmidlin . | |
| 4,912,489 | 3/1990 | Schmidlin . | |
| 5,028,812 | 7/1991 | Bartky . | |
| 5,036,341 | 7/1991 | Larsson . | |
| 5,038,159 | 8/1991 | Schmidlin et al. . | |
| 5,049,469 | 9/1991 | Pierce | 430/109 |
| 5,057,855 | 10/1991 | Damouth . | |
| 5,072,235 | 12/1991 | Slowik et al. . | |
| 5,083,137 | 1/1992 | Badyal et al. . | |
| 5,095,322 | 3/1992 | Fletcher . | |
| 5,121,144 | 6/1992 | Larson et al. . | |
| 5,128,695 | 7/1992 | Maeda . | |
| 5,148,595 | 9/1992 | Doggett et al. . | |
| 5,153,093 | 10/1992 | Sacripante | 430/138 |
| 5,170,185 | 12/1992 | Takemura et al. . | |
| 5,181,050 | 1/1993 | Bibl et al. . | |
| 5,204,696 | 4/1993 | Schmidlin et al. . | |
| 5,204,697 | 4/1993 | Schmidlin . | |
| 5,214,451 | 5/1993 | Schmidlin et al. . | |
| 5,229,794 | 7/1993 | Honman et al. . | |
| 5,235,354 | 8/1993 | Larson . | |
| 5,237,346 | 8/1993 | Da Costa et al. . | |
| 5,256,246 | 10/1993 | Kitamura . | |
| 5,257,045 | 10/1993 | Bergen et al. . | |
| 5,270,729 | 12/1993 | Stearns . | |
| 5,274,401 | 12/1993 | Doggett et al. . | |
| 5,305,026 | 4/1994 | Kazuo | 347/55 |
| 5,307,092 | 4/1994 | Larson . | |
| 5,328,791 | 7/1994 | Ohta | 430/106 |
| 5,329,307 | 7/1994 | Takemura et al. . | |
| 5,374,949 | 12/1994 | Wada et al. . | |
| 5,386,225 | 1/1995 | Shibata . | |
| 5,402,158 | 3/1995 | Larson . | |
| 5,414,500 | 5/1995 | Furukawa . | |
| 5,446,478 | 8/1995 | Larson . | |
| 5,450,115 | 9/1995 | Bergen et al. . | |
| 5,453,768 | 9/1995 | Schmidlin . | |
| 5,473,352 | 12/1995 | Ishida . | |
| 5,477,246 | 12/1995 | Hirabayashi et al. . | |
| 5,477,250 | 12/1995 | Larson | 347/55 |
| 5,506,666 | 4/1996 | Masuda et al. . | |
| 5,508,723 | 4/1996 | Maeda . | |
| 5,515,084 | 5/1996 | Larson . | |
| 5,526,029 | 6/1996 | Larson et al. . | |
| 5,558,969 | 9/1996 | Uyttendaele et al. . | |
| 5,600,355 | 2/1997 | Wada . | |
| 5,614,932 | 3/1997 | Kagayama . | |
| 5,617,129 | 4/1997 | Chizuk, Jr. et al. . | |
| 5,625,392 | 4/1997 | Maeda . | |
| 5,640,185 | 6/1997 | Kagayama . | |
| 5,650,809 | 7/1997 | Kitamura . | |
| 5,666,147 | 9/1997 | Larson . | |
| 5,677,717 | 10/1997 | Ohashi . | |
| 5,708,464 | 1/1998 | Desie . | |
| 5,774,159 | 6/1998 | Larson . | |
| 5,801,729 | 9/1998 | Kitamura | 347/55 |
| 5,805,185 | 9/1998 | Kondo . | |
| 5,818,480 | 10/1998 | Bern et al. . | |
| 5,818,490 | 10/1998 | Larson . | |

FOREIGN PATENT DOCUMENTS

| | | |
|---|---|---|
| 26 53 048 | 5/1978 | Germany . |
| 44-26333 | 11/1969 | Japan . |
| 55-55878 | 4/1980 | Japan . |
| 58-4671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-13356 | 11/1987 | Japan . |
| 01120354 | 5/1989 | Japan . |
| 05220963 | 8/1990 | Japan . |
| 04186554 | 8/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2180432 | 5/1983 | United Kingdom . |
| 9014960 | 12/1990 | WIPO . |

IMAGE FORMING METHOD AND DEVICE UTILIZING CHEMICALLY PRODUCED TONER PARTICLES

This application is a continuation-in-part of U.S. patent application No. 08/989,554, filed Dec. 12, 1997.

BACKGROUND OF THE INVENTION

1. Field of the Invention

The present invention is within the field of electrographical printing devices in which a modulated stream of pigment particles is transported from a particle source through an apertured printhead structure and deposited in image configuration onto an image receiving medium. More specifically, the invention relates to an improvement of the properties of said pigment particles in order to obtain an improved printing result in a direct printing process.

2. Description of the Related Art

Of the various electrostatic printing techniques, the most familiar and widely utilized is that of xerography, wherein latent electrostatic images formed on a charge retentive surface, such as a roller, are developed by a toner material to render the images visible, the images being subsequently transferred to plain paper. This process is called an indirect printing process since the images are first formed on an intermediate photoreceptor and then transferred to a paper surface.

Another form of electrostatic printing is known as direct electrostatic printing (DEP). Many of the methods used in DEP, such as particle charging, particle transport, and particle fusing are similar to those used in xerography. However, DEP differs from xerography in that an electric field is generated by electrical signals to cause toner particles to be deposited directly onto plain paper to form visible images without the need for those signals to be intermediately converted to another form of energy. The novel feature of the DEP concept is the simultaneous field imaging and toner transport to produce visible images directly onto plain paper or any suitable image receiving medium.

U.S. Pat. No 5,036,341 granted to Larson discloses a DEP printing device and a method to produce text and pictures with toner particles on an image receiving substrate directly from computer generated signals. The Larson patent discloses a method which positions a control electrode array between a back electrode and a rotating particle carrier. An image receiving substrate, such as paper, is then positioned between the back electrode and the control electrode array.

An electrostatic field on the back electrode attracts the toner particles from the surface of the toner carrier to create a particle stream toward the back electrode. The particle stream is modulated by voltage sources which apply an electric potential to selected individual control electrodes to create electrostatic fields which either permit or restrict the transport of toner particles from the particle carrier through the control electrode array. In effect, these electrostatic fields "open" or "close" selected apertures in the control electrode array to the passage of toner particles by influencing the attractive force from the back electrode. The modulated stream of charged toner particles allowed to pass through the opened apertures impinges upon a print-receiving medium interposed in the particle stream to provide line-by-line scan printing to form a visible image.

The control electrode array of the above-mentioned patent may take on many designs, such as a lattice of intersecting wires arranged in rows and columns, or a screen shaped, apertured printed circuit. Generally, the array is formed of a thin substrate of electrically insulating material provided with a plurality of apertures each of which is surrounded by an individually addressable control electrode, and a corresponding voltage source is connected thereto for attracting the charged toner particles from the particle carrier to the image receiving substrate by applying voltage signals in accordance with the image information. For example, the control electrode array may be constructed of a flexible, non-rigid material and overlaid with a printed circuit such that apertures in the material are arranged in several rows and surrounded by electrodes.

Toner particles are held on the surface of the particle carrier by an adhesion force which is substantially related to the particle charge and to the distance between the particle and the surface of the particle carrier. The electrostatic field applied on a control electrode to initiate toner transport through a selected aperture is chosen to be sufficient to overcome the adhesion force to cause the release of an appropriate amount of toner particles from the particle carrier. The electrostatic field is applied during the time period required for these released particles to reach sufficient momentum to pass through the selected aperture, whereafter the transported toner particles are exposed to the attraction force from the back electrode and intercepted by the image receiving substrate.

Properties, such as charge amount, charge distribution, particle diameter, etc., of the individual toner particles have been found to be of particularly great importance to print performance in a direct printing method. Accordingly, the size and size-distribution of the toner particles affects the printing result, since large toner particles have a tendency to cause clogging of the apertures in the control electrode array. In addition, the toner particles allowed to pass through selected opened apertures are accelerated toward the transfer belt under the influence of a uniform attraction field from the back electrode. In order to control the distribution of transported particles onto a printing substrate, the particles may be deflected by the application of a deflection pulse, resulting in an increase in the addressable area on the printing substrate. However, small particles having a low surface charge exhibit poor deflection properties.

Moreover, variations in charge amount and charge distribution affect the print uniformity and print quality of a direct printing method. Particularly, a non-uniform charge distribution on the surface of the particles may cause the formation of highly charged areas, or "hot spots" on the particle surfaces. Such hot spots are highly undesirable, since they may cause the toner particles to arrange themselves into chains or particle networks, resulting in an increased tendency to form clusters. Furthermore, the charge distribution has been found to affect the release of toner particles from the particle carrier. A non-uniform particle distribution also increases clogging of the apertures in the control electrode array. Accordingly, a non-uniform charge distribution and the formation of hot spots on the surface of the toner particles result in impaired release properties and clogging. Another negative effect of a non-uniform charge-distribution is increased dispersion of toner particles in the printing process.

To meet the requirements of higher resolution printing, such as for example 600 dpi printing, wherein the dot size is to be in the order of 60 microns, it is essential to provide DEP methods with improved dot size control, while ensuring minimal toner particle dispersion. Therefore, a more uniform characteristic and a smaller average diameter is required for the toner to efficiently improve the print quality, resolution and uniformity of DEP methods.

SUMMARY OF THE INVENTION

An object of the present invention is to provide an image recording device and a method in which print performance can be considerably improved by utilizing chemical toner particles having an average diameter comprised in the range of 4 to 8 microns, and preferably in the range of 3–6 microns.

In accordance with a preferred embodiment of the invention, the toner particle size distribution is controlled such that less than 15% of the toner particles have an average diameter larger than 6 microns.

By utilizing chemical toner particles having a small and largely uniform size, it is possible to achieve superior print results as compared to methods using larger toner particles and/or toner particles of varying size. Small particles melt over a smaller area after fusing, which makes it possible to print sharper dots, lines and images with small particles then with large particles.

In addition, a non-uniform charge distribution leads to more wrong sign toner (WST) in different environmental conditions. Too much WST on the surface of the control array influences the toner amount and the dot position on the print receiving substrate.

By contrast, a uniform charge distribution leads to higher printing speed as all toner particles in the same dot reaches the print receiving substrate during a shorter time interval.

Moreover, chemical toner particles can be produced with high pigment concentration in the toner particles, implying that it is possible to use a smaller quantity of toner particles in order to obtain a certain, predetermined pigment coverage of a print substrate. The reason for this is that a larger area can be covered with the same mass of toner particles if the particles are small than if large particles are used. Theoretically, large particles with a high pigment concentration could be used. However, the high fusing pressure needed to smear the pigment out over a large area would result in difficulties to control line sharpness and ID and could affect the transparency or other qualities of the printing substrate.

Furthermore, chemical toner particles can be produced having a regular shape with a spherical or convex surface which means that such particles exhibit less contact area between the toner particles or between the toner particles and the developer contact area. This leads to lower dispersive and mirror forces between the toner particles or between the toner particles and the developer. If the toner particles have a narrow size distribution, the contact area is even further reduced since uniformly sized and shaped particles cannot be as closely packed as particles of different sizes and shapes.

It has further been found, that chemically produced toner particles have a more narrow charge distribution. In particular, the occurrence of extremely highly charged toner particles is considerably reduced, whereby the creation of a mirror force which would cause toner particles to become strongly bound to the developer sleeve can be avoided. Another positive result of a uniform charge distribution is that a more uniform release of toner particles from the developer sleeve can be achieved. The release properties are also expected to be advantageously affected by the fact that chemically produced toner particles are produced under equilibrium, relaxed and non-stressed conditions and as a result have a more chemically and physically homogeneous surface without mechanical defects, as compared to conventionally used crushed toner. Accordingly, the chemical toner particles are believed to have a more even charge distribution on the toner surface and are considerably less likely to exhibit hot spots.

Further advantages may be obtained with toner particles having a uniform shape and a surface without irregularities. Chemically produced toner particles have a homogeneous shape which leads to a more smooth tribo charging process since the toner particles may be frictionally charged by rolling under a doctor blade as opposed to charging by irregularly shaped particles hitting each other and the doctor blade while passing under it. Moreover, small and/or spherical toner particles are believed to cause a minimum of clogging of the apertures in the control electrode array.

Since pigment, waxes, CCA etc. are dispersed or solved in the toner in a much more controlled way in chemical toner particles than in crushed toner particles, they give a higher relative effect at the same time as transparency and defects of having them appearing at places where they are not needed is avoided.

In an image recording method in accordance with the present invention, the toner particles utilized are preferably obtained by micro-encapsulation techniques, including the basic steps of: (a) forming a dispersion of a core material in a medium containing a shell material; (b) depositing the shell material upon the surface of the core material to form capsules; (c) hardening the capsules to prevent their agglomeration; and (d) recovering the capsules. The continuous phase in step (a) is normally a solution of the shell material. The core structure advantageously comprises a colorant and at least one additive, such as, for example, a resin binder.

An advantage of using encapsulated toner particles in a direct printing process is that the surface of each particle will consist of a chemically pure material which tends to shield the materials added to the core from the tribocharging process. This implies, for instance, that the charge characteristics of the toner particles will be color independent. Furthermore, the shell material can be given a higher resistance to temperature and mechanical impacts then the core material. In this manner it is possible to use a lower fusing temperature.

Chemical toner particles can be produced using other techniques such as precipitation, emulsion, etc.

DETAILED DESCRIPTION OF THE PREFERRED EMBODIMENT

Figure 1:
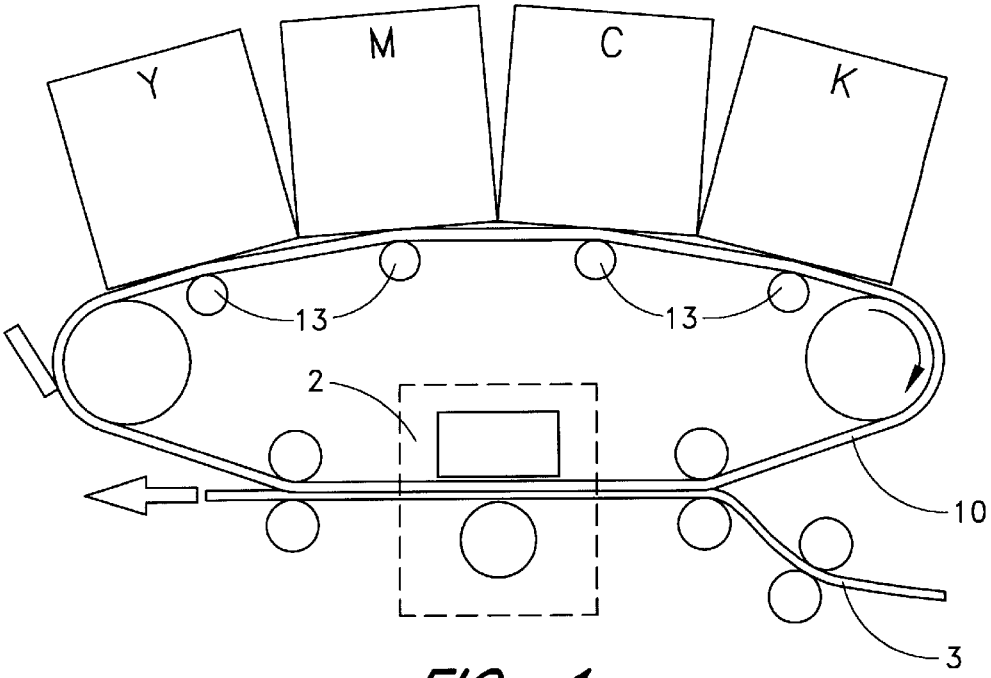
FIG. 1 is a schematic view of an image recording apparatus.
Figure 2:
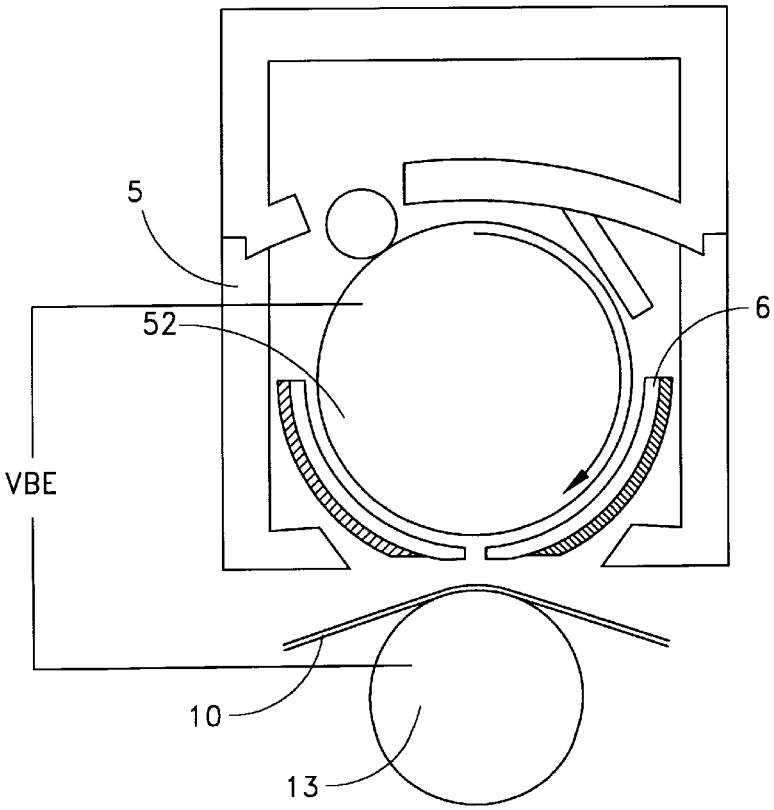
FIG. 2 is a schematic sectional view across a print station.

A preferred embodiment according to this invention will be described with reference to the accompanying drawings. FIG. 1 illustrates schematically an image forming apparatus according to the present invention. An intermediate image receiving member 10, such as a transfer belt, is successively conveyed past four print stations Y, M, C, K, each corresponding to a specific color, for instance, yellow, cyan, magenta and black, to intercept a modulated stream of toner particles from each print station Y, M, C, K in such a manner that the so obtained four image configurations are directly superposed onto the transfer belt 10, forming a visible four-color toner image. As shown in FIG. 2, each of the print stations Y, M, C, K includes a toner particle delivery unit 5 having a particle source, such as a rotating toner carrier 52, disposed adjacent to the transfer belt 10. A printhead structure 6, such as an apertured electrode matrix is arranged between the toner carrier 52 and the transfer belt 10 for modulating the stream of toner particles from the toner carrier 52. The toner image formed onto the transfer belt 10 is brought into contact with an information carrier 3, such as paper, delivered from a paper feeding unit, whereas the toner image is transferred to paper 3 in a fusing unit 2, in which the image is made permanent on paper 3.

Figure 3:
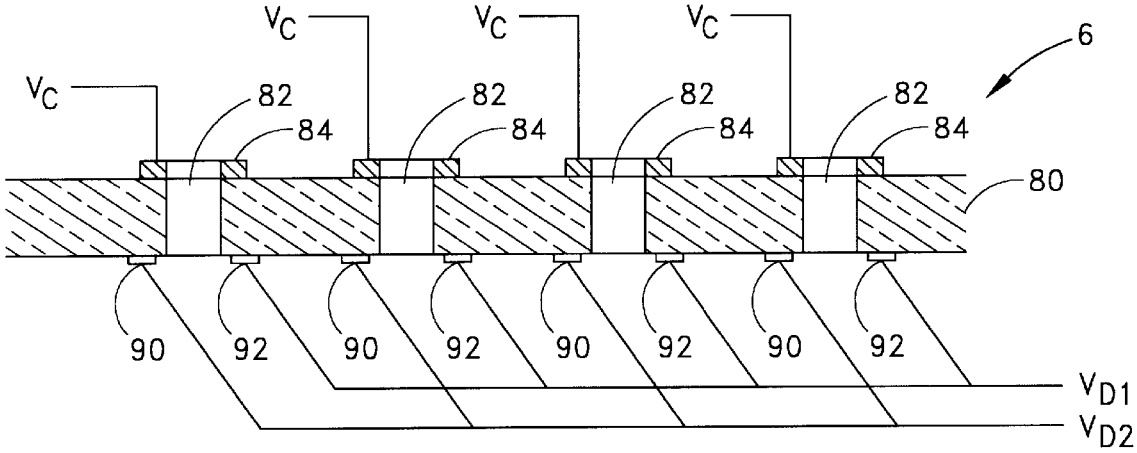
FIG. 3 is a cross-sectional view of a plurality of apertures surrounded by control electrodes and deflection electrodes.

As shown in FIG. 2, a background voltage source produces an electric potential difference VBE between the toner carrier 52 and a back electrode roller 13 supporting the transfer belt 10 for creating an attraction field which enables toner transport from the toner carrier 52 toward the back electrode roller 13. As shown in FIG. 3, the printhead structure 6 is preferably formed of an electrically insulating substrate 80 provided with a plurality of apertures 82 each of which is surrounded with a control electrode 84 connected to a control voltage source $V_c$, which due to control in accordance with the image information, supplies electrostatic control fields which open or close the corresponding aperture, thereby permitting or restricting toner transport through said aperture. The toner particles allowed to pass through selected opened apertures are accelerated toward the transfer belt 10 under influence of the attraction field from the back electrode roller 13.

According to a preferred embodiment of the present method, the printhead structure 6 further includes at least two sets of deflection electrodes 90, 92, each set being connected to a deflection voltage source $V_{D1}$, $V_{D2}$ which sequentially supplies deflection signals for modifying the symmetry of the electrostatic control fields, thereby controlling the transport trajectory of toner particles toward predetermined locations on the image receiving medium 3. According to that embodiment, the method is performed in consecutive deflection sequences, each related to a specific deflection direction, thereby allowing each aperture in the printhead structure to address several dot locations on the image receiving medium, resulting in that the print addressability can be significantly enhanced without increasing the number of apertures, control electrodes and control voltage sources required. For instance, a print addressability of 600 dpi can be obtained by performing three deflection sequences in each print step, utilizing a printhead structure having 200 apertures per inch.

Figure 4:
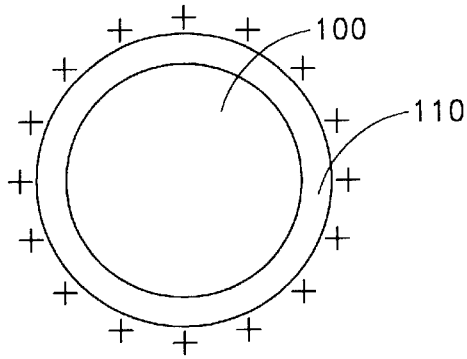
FIG. 4 is a cross-sectional view of an exemplary particle showing the inner core and outer shell structure.

However, 600 dpi print resolution requires an efficient dot size control, which is made possible by the utilization of a one-component, non-magnetic chemically produced toner material, preferably a micro-encapsulated toner material, in which the average particle diameter is comprised in a range of 4 microns to 8 microns. The characteristics of the toner particles utilized in the above method differs from the toner properties required in conventional methods, such as xerography, in that the particles have to be propulsed at a relatively high velocity against the image receiving substrate in a controlled manner without being deflected from the intended point of collision against said substrate. As shown in FIG. 4, to meet this requirement, the toner particles utilized in the above method preferably comprises a core structure 100 being encapsulated within a substantially spherical shell structure 110 made of a condensation polymer, such as for example polyurea, polyurethane, polyester, polyamide, polycarbonate or the like. A micro-encapsulated toner material suitable for the present method is obtained by phase separation of one or both of the shell material and the core material, such a method generally including the basic steps of: (a) forming a dispersion of a core material in a medium containing a shell material; (b) depositing the shell material upon the surface of the core material to form capsules; (c) hardening the capsules to prevent their agglomeration; and (d) recovering the capsules. The continuous phase in step (a) is normally a solution of the shell material. The core material is preground to the desired size and then dispersed within the solution. Step (b) generally involves changing the conditions in such a way as to cause phase separation of the shell material from the continuous shell solution phase. Normally the wall material is caused to phase-separate as a coherent liquid film around the particles of the core phase. The liquid or gelatinous shell phase must be hardened in step (c) before recovery of the capsules. Capsule recovery can be effected by filtering, centrifuging or the like, followed by drying. The control of particle size is generally established in steps (a) or (b) and is achieved by varying the type and degree of agitation and by use of surfactants and thickeners to modify the interfacial tensions and viscosities. The size of micro-encapsulated polymerized toner obtained by the above method can easily be controlled to be in the range of 4 microns to 8 microns.

What is claimed is:

1. An image recording method comprising:

(a) feeding one-component, non-magnetic chemically produced toner particles onto a toner particle source disposed adjacent to a back electrode, said toner particles having an average diameter comprised in the range of 4 microns to 8 microns and preferably in the range of 3 microns to 6 microns, said toner particles having substantially uniform charge distributions;

(b) producing an electric potential difference between the particle source and the back electrode to provide an electric attraction field which enables the transport of said toner particles from the particle source toward the back electrode;

(c) providing an apertured printhead structure in said attraction field, said printhead structure including a pattern of individually addressable control electrodes;

(d) connecting variable voltage sources to said control electrodes to produce a pattern of electrostatic fields which selectively permit or restrict the transport of toner particles through the aperture so said printhead structure by influencing said attraction field in accordance with an image information; and (e) conveying an image receiving medium between the printhead structure and the back electrode to intercept the transported toner particles in image configuration.

2. An image recording apparatus comprising at least one print station including:

a toner delivery unit for feeding one-component, non-magnetic polymerized toner particles onto a particle source disposed adjacent to a back electrode, said toner particles having an average diameter comprised in the range of 4 microns to 8 microns, said toner particles having substantially uniform charge distributions;

an apertured printhead structure formed of an electrically insulating substrate having a plurality of apertures arranged therethrough, each of said apertures being at least partially surrounded by an individually addressable control electrode;

variable voltage sources connected to said control electrodes for converting an image information to electrostatic control fields for selectively permitting or restricting the transport of toner particles from the particle source through said apertures; and an image receiving medium for intercepting the toner particles transported through the apertures, to form an image configuration.

3. An image recording apparatus as defined in claim 2, in which the image receiving medium is a transfer belt conveyed adjacent to said printhead structure.

4. An image recording apparatus as defined in claim 2, comprising four different print stations, each of which corresponds to a specific colorant contained in said toner particles.

5. An image recording apparatus as defined in claim 4, in which the image receiving medium is a transfer belt conveyed in positions adjacent to said four print stations.

6. An image recording apparatus as defined in claim 2, in which the particle source is a rotating substantially cylindrical roller.

7. An image recording apparatus as defined in claim 2, in which the toner delivery unit further includes a toner layer regulating member for providing a uniform layer of toner particles on a surface of the particle source while frictionally charging said toner layer.

8. An image recording apparatus as defined in claim 2, in which the printhead structure further includes at least two sets of deflection electrodes, each set being connected to a deflection voltage source supplying deflection fields which sequentially modify the symmetry of said electrostatic control fields to control the transport trajectories of toner particles toward predetermined locations on the image receiving medium.

9. An image recording apparatus as defined in claim 2, further comprising a transfer unit in which said image receiving medium is brought into contact with an information carrier for transferring said image configuration onto said information carrier.

10. An image recording apparatus as defined in claim 9, further comprising a fusing unit in which said image configuration is made permanent on said information carrier.

11. An image recording apparatus as defined in claim 1, in which each said toner particle has a core structure encapsulated within a shell structure said core structure comprising a colorant and at least one additive, such as resin binder.

12. An image recording apparatus as defined in claim 1, in which each said toner particle has a substantially spherical shape.

* * * * *